US006898394B2

(12) United States Patent
Schuller et al.

(10) Patent No.: US 6,898,394 B2
(45) Date of Patent: May 24, 2005

(54) MOUNTING A PRINT MEDIA OUTPUT DEVICE

(75) Inventors: Peter D. Schuller, Coon Rapids, MN (US); Thomas G. Lindblom, Claremont, MN (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 63 days.

(21) Appl. No.: 10/396,278

(22) Filed: Mar. 24, 2003

(65) Prior Publication Data

US 2004/0190931 A1 Sep. 30, 2004

(51) Int. Cl.[7] ..... G03G 15/00
(52) U.S. Cl. ..... 399/107; 399/405
(58) Field of Search ..... 399/107, 110, 399/405, 407, 408, 409, 410

(56) References Cited

U.S. PATENT DOCUMENTS 3,768,064 A * 10/1973 Pabich ..... 439/370
5,666,595 A * 9/1997 Sameshima et al. ..... 399/110
6,050,708 A * 4/2000 Roorda ..... 362/375
6,158,690 A * 12/2000 Wadey et al. ..... 244/17.27
6,253,057 B1 * 6/2001 Yamanaka ..... 399/407
6,311,032 B1 * 10/2001 Carter et al. ..... 399/107
6,457,705 B2 * 10/2002 Nanba et al. ..... 399/407 X
6,549,734 B2 * 4/2003 Yamada et al. ..... 399/407 X
6,641,129 B2 * 11/2003 Ogita et al. ..... 399/407 X
6,741,222 B1 * 5/2004 Tucker ..... 345/1.1

* cited by examiner

*Primary Examiner*—Sandra L. Brase

(57) ABSTRACT

In one embodiment of the invention, a print media output device includes a frame, a rail integral to each side of the frame, an output receptacle extending between and mounted to the rails for movement thereon, and a quick release fastener connected to the frame. In another embodiment of the invention, a print media output device includes a rectangular frame, a horizontally oriented output receptacle extending between sides of the frame, and quick release fasteners connected to the top and bottom of the frame. In one embodiment, the quick release fasteners include key hole plugs and a quarter turn fastener.

16 Claims, 8 Drawing Sheets

MOUNTING A PRINT MEDIA OUTPUT DEVICE

FIELD OF THE INVENTION

The invention involves mounting a print media output device to a printer or post print finishing device. More particularly, and by way of example and not limitation, the invention is directed to a print media output device that includes quick release fasteners for mounting the output device to the printer or post print finishing device.

BACKGROUND

Printed documents are typically output by printers and post print finishing devices into a tray, bin or other receptacle. In some output devices, the receptacle is driven up and down to accommodate the output of different types and sizes of documents or groups of documents. The present invention was developed in an effort to provide an output device that could be easily mounted to different printers and post print finishing devices.

DETAILED DESCRIPTION

Figure 1:
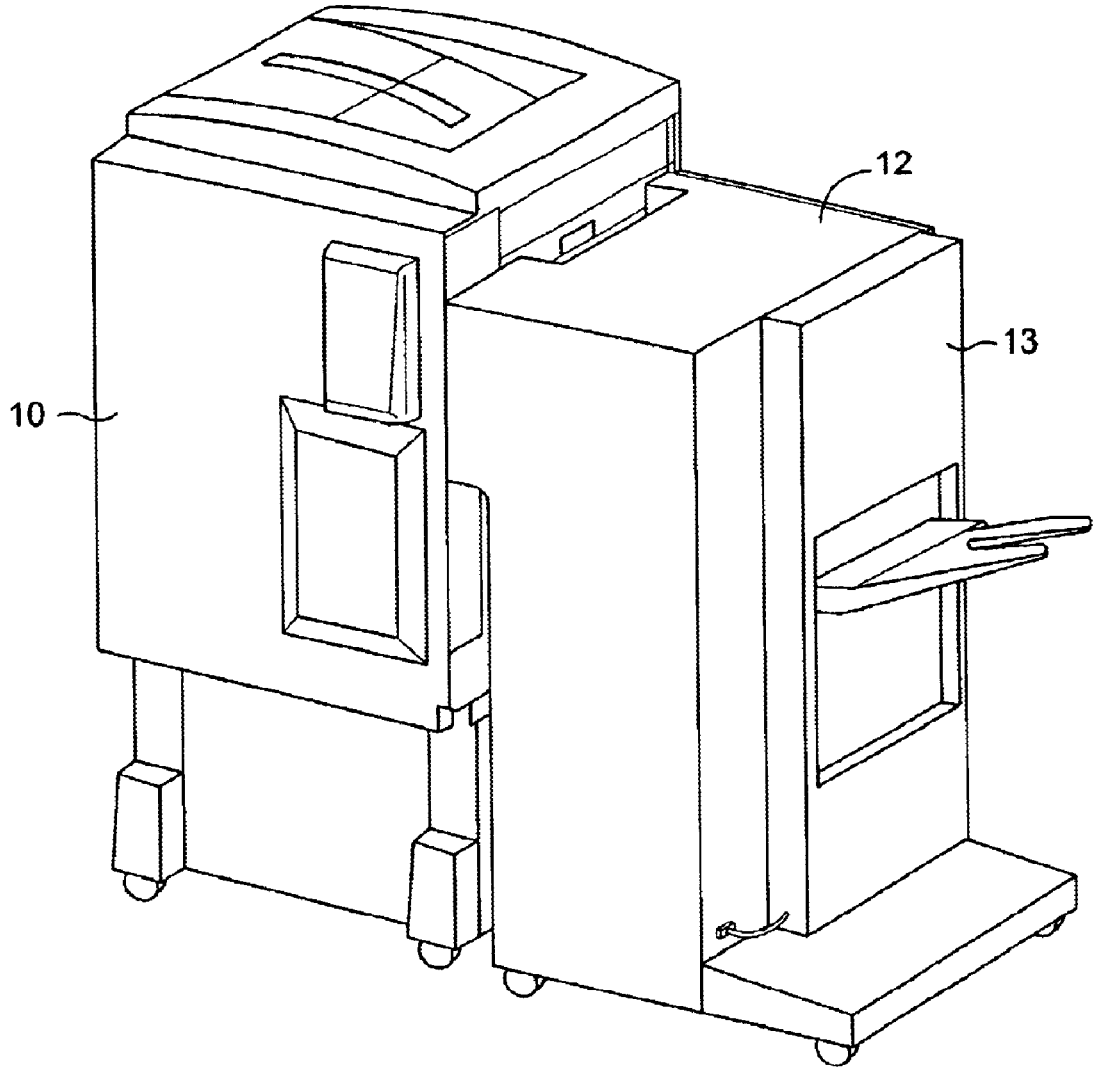
FIG. 1 is a perspective side view illustrating a printer with an attached post print finishing device.
Figure 2:
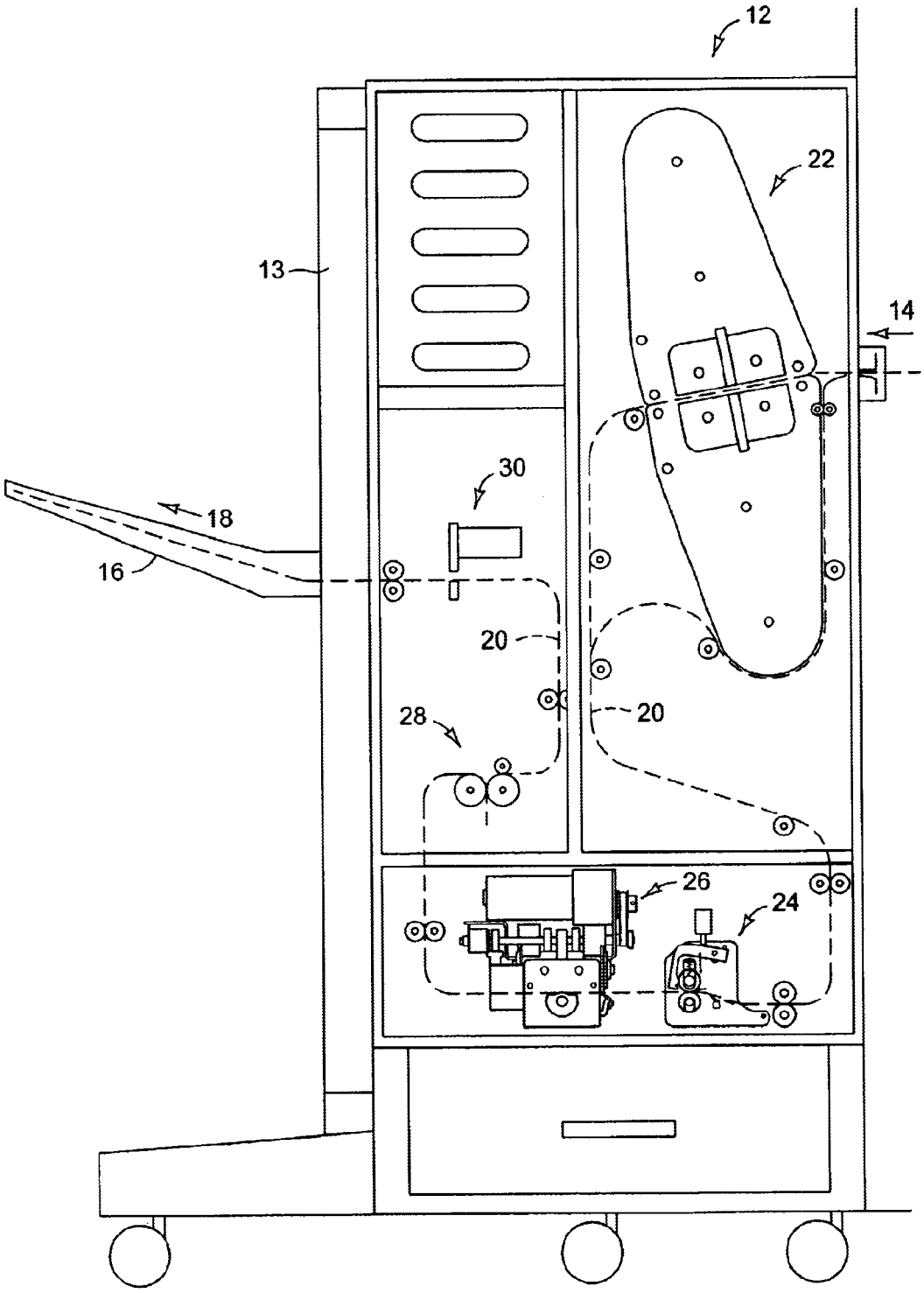
FIG. 2 is an elevation side view illustrating the major components and media path through a post print finishing device such as the one shown in FIG. 1.

FIG. 1 illustrates a printer 10 with an attached post print finishing device 12 and a stand alone output device 13 mounted to finishing device 12. FIG. 2 illustrates the major components and media path through a post print finishing device such as the one shown in FIG. 1. FIGS. 1–2 illustrate one exemplary environment in which embodiments of a stand alone stacker, sorter or other print media output device 13 of the present invention might be implemented. While the finishing device 12 of FIG. 2 includes sheet coating, trimming and stapling, and booklet making capabilities, embodiments of the invention may be used with any printer or post print finishing device in which it may be desirable to use a stand alone stacker, sorter or other print media output device.

Printer is used broadly in this document to mean any printing device including, for example, laser printers, inkjet printers, copiers and multi-function devices.

Referring now also to FIG. 2, printed media sheets are output to finishing device 12 as noted by arrow 14, and discharged from finishing device 12 to output tray 16 as noted by arrow 18. Tray 16 is part of output device 13 mounted to finishing device 12. The media path through finishing device 12 is indicated by broken line 20 in FIG. 2. Media sheets output to finishing device 12 are transported through or around coating unit 22 to a pre-trim registration unit 24, trimming unit 26, folding unit 28 and stapling unit 30 before they are discharged to output tray 16.

Coating unit 22 coats printed media with a film of clear flexible material. Such coatings can be formulated and applied to help protect the printed image, enhance the printed image or provide a more uniform gloss level across the entire media (including both printed and unprinted areas). If a coating is not desired, then media sheets are moved along a bypass path around coating unit 22. Pre-trim registration unit 24 registers each sheet to trimming unit 26 before it enters trimmer 26. That is to say, registration unit 24 straightens or "deskews" each sheet as necessary to ensure the sheet is properly aligned in the media path as it enters trimmer 26. Trimming unit 26 trims the leading edge of each sheet or the trailing edge of each sheet, or both, as necessary to make the sheet the desired size for the finished booklet or other document. Folding unit 28 folds each sheet by creasing the sheet along the desired fold line. Stapling unit 30 staples each booklet after the sheets are trimmed, folded and assembled.

Figure 3:
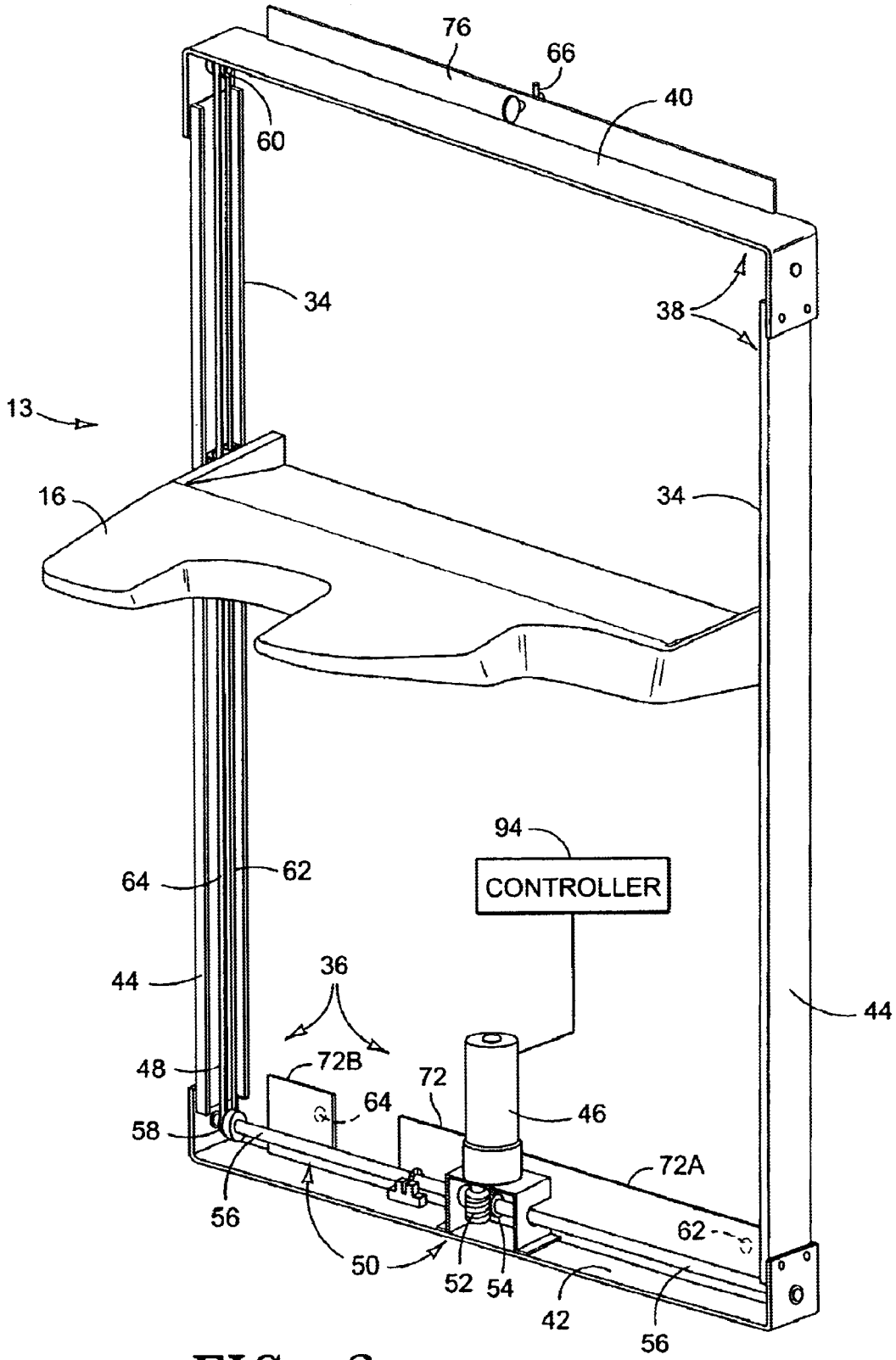
FIG. 3 is a perspective rear side view of an output device that incorporates quick release mounting fasteners according to one embodiment of the invention.
Figure 4:
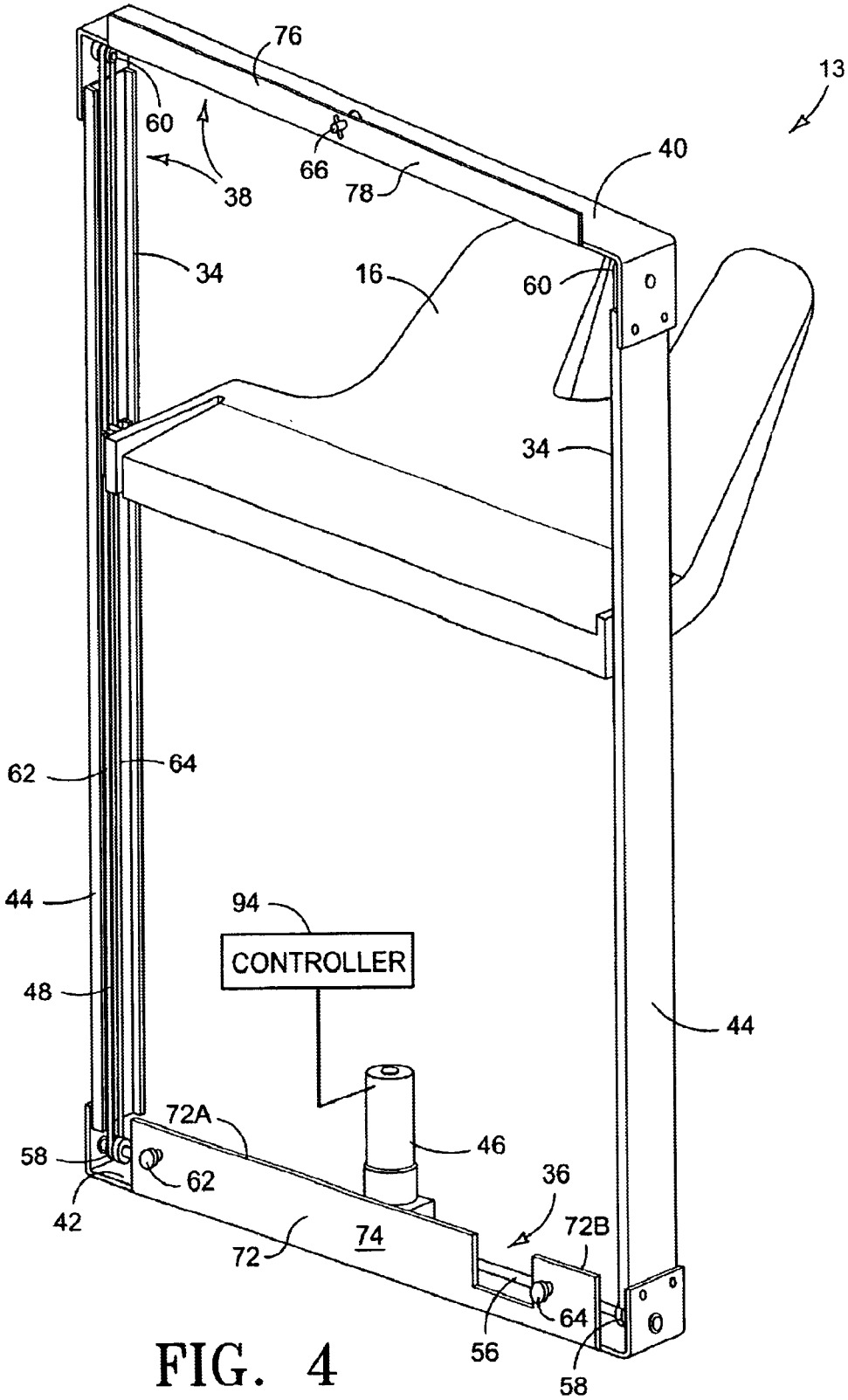
FIG. 4 is a perspective front side view of the output device of FIG. 3.

FIGS. 3 and 4 are perspective rear and front views, respectively, of an output device 13 constructed according to one embodiment of the invention. (The cover for output device 13 is removed and not shown in FIGS. 3 and 4.) Referring to FIGS. 3–4, output device 13 includes output tray 16, tray drive system 36 and frame 38. Frame 38, typically rectangular, includes a top 40 and a bottom 42 that extend between sides 44. Tray drive system 36 includes a reversing motor 46, endless loop belts 48 and a drive train 50 that couples motor 46 and belts 48.

In the embodiment shown in FIGS. 3 and 4, drive train 50 includes a drive gear 52, driven gears 54, drive shafts 56, belt drive wheels 58 and belt idler wheels 60. Motor 46 is mounted to frame bottom 42. The outboard ends of drive shafts 56 are supported on bearings or bushings (not shown) in frame bottom 40. A worm gear or other suitable drive gear 52 is connected to motor 46. Spur gears or other suitable driven gears 54 are mounted to the inboard ends of shafts 56. Driven gears 54 engage drive gear 52 to turn shafts 56. Belt drive wheels 58 are mounted near the outboard ends of shafts 56 and turn with shafts 56 at the bottom of rails 34. Belt idler wheels 60 are mounted to frame 38 at the top of rails 34. Each endless loop belt 48, which wraps wheels 58 and 60, is characterized by an inner run 62 and an outer run 64. Tray 16 is mounted between and moves along rails 34 at the urging of motor 46. Any suitable slide mechanism may be used for mounting tray 16 to rails 34. Two suitable slide mechanisms are described in commonly assigned U.S. patent application Ser. No. 10/396,276 (attorney docket no. 100203756-1) filed Mar. 24, 2003 and entitled "Print Media Output Receptacle Rail Support And Drive System", incorporated herein by reference in its entirety.

Rails 34 are attached to or integral with sides 44. In one preferred embodiment, which is shown in the FIGS. 3 and 4, each rail 34 is coextensive with and defines each side 44. In this preferred embodiment, rail 34 functions both as the structural side of frame 38 as well as the support/guide for the travel of tray 16. Commercially available "off the shelf" linear slide rails are readily adapted for use as rails 34 to provide a lower cost option for a sorter or stacker frame. Also, simultaneously driving both sides of tray 16 with identical drive train components (belts 48, gears 52 and 54, and wheels 58 and 60) keeps even an inexpensive plastic tray 16 properly aligned.

Quick release fasteners are used to mount output device 13 to a printer or, in the example shown in the Figures, to a post print finishing device 12. In the embodiment shown in FIGS. 3–6, a pair of key hole plugs 62, 64 and a quarter turn fastener 66 are used as the quick release fasteners. In the embodiment shown in FIGS. 7–8, two pair of key hole plugs 62, 64 and 68,70 are used as the quick release fasteners. "Key hole plug" refers generally to any post or other protrusion that terminates in a head or other relatively larger size retaining part. "Key hole" refers generally to any dual size opening configured to accept and retain a key hole plug.

Figure 5:
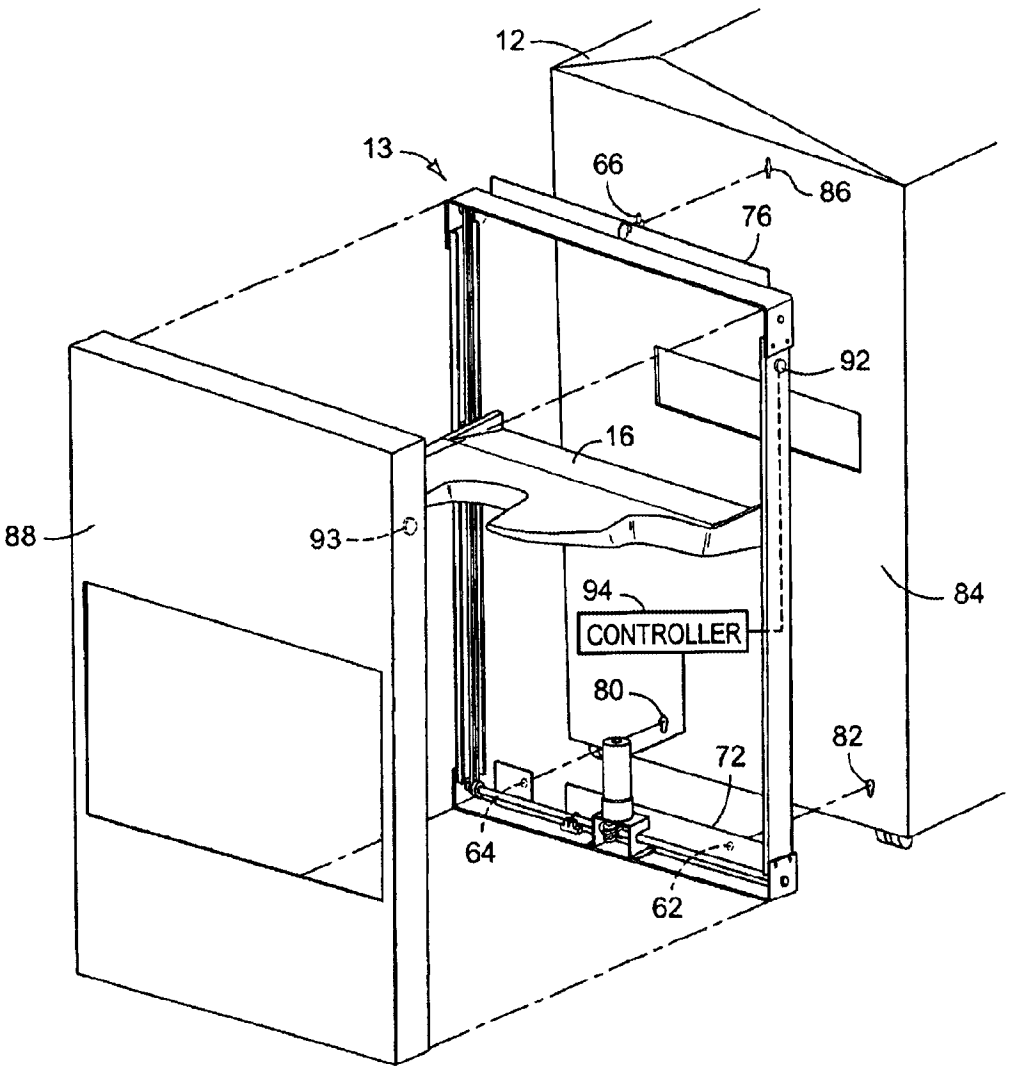
FIGS. 5 and 6 are exploded perspective views showing the output device of FIGS. 3 and 4 mounting to a printer or post print finishing device.

Referring first to FIGS. 3–6, a lower mounting flange 72 extends along the inside/upstream edge of frame bottom 42. Key hole plugs 62 and 64 protrude from an inside/upstream mounting surface 74 of flange 72. Flange 72 may be continuous along frame bottom 42 or, if necessary or desirable, broken into segments as shown in FIGS. 3–5 (flange segments 72A and 72B). Flange 72 may be attached to or integral with frame bottom 42. Flange 72 may project up or down from frame bottom 42 or flange 72 may be coextensive with and define frame bottom 42.

An upper mounting flange 76 extends along the inside/upstream edge of frame top 40. Quarter turn fastener 66 protrudes from an inside/upstream mounting surface 78 of flange 76, preferably at or near the center of flange 76. Flange 76 may be continuous along frame top 40 as shown in FIGS. 3–5 or, if necessary or desirable, broken into segments. Flange 76 may be attached to or integral with frame top 40. Flange 76 may project up or down from frame top 40 or flange 76 may be coextensive with and define frame top 40.

Figure 6:
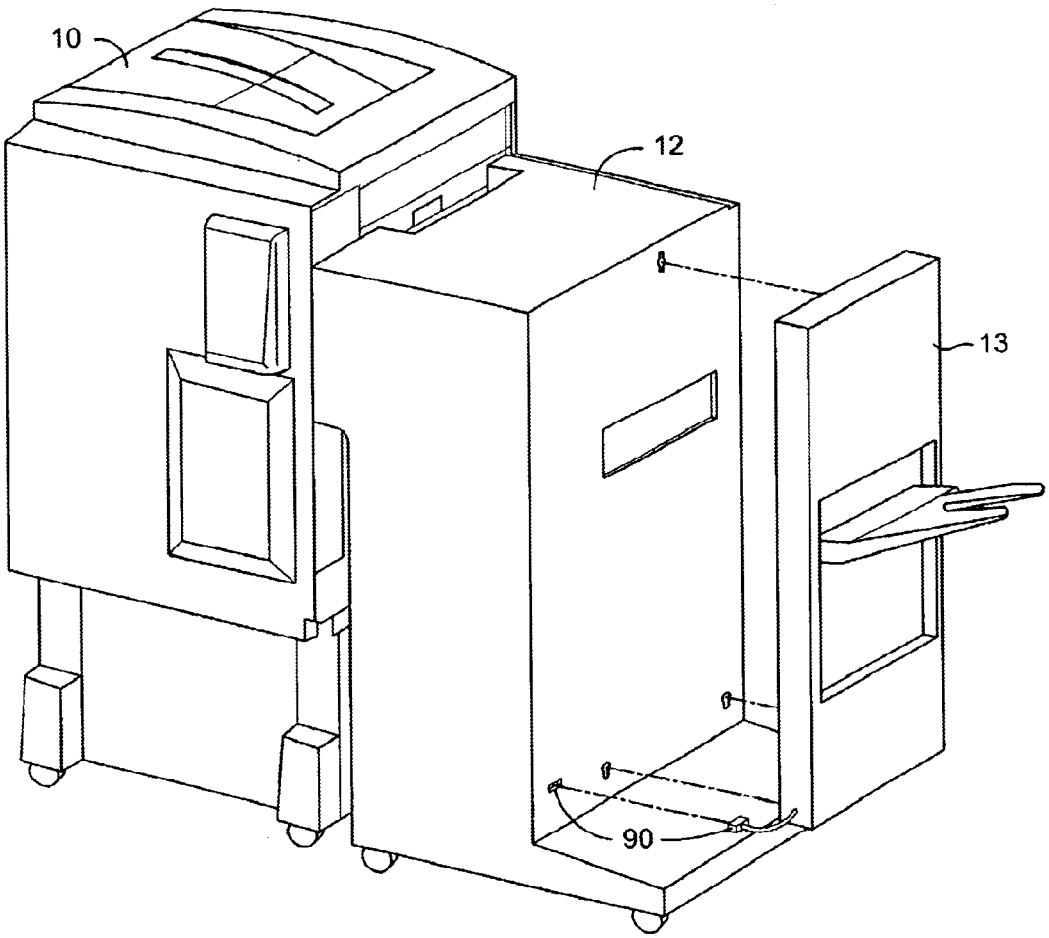

Flanges 72 and 76 provide mounting surfaces 74 and 78, respectively, for mounting output device 13 to finishing device 12. FIGS. 5 and 6 are exploded views showing output device 13 mounting to finishing device 12. Key holes 80 and 82 in housing panel 84 of finishing device 12 are aligned with key hole plugs 64 and 62, respectively, on output device 13. A T slot 86 in housing panel 84 of finishing device 12 is aligned with quarter turn fastener 66 on output device 13. With output device cover 88 removed, output device 13 is easily mounted to finishing device rear panel 84 by inserting key hole plugs 64 and 62 into key holes 80 and 82, respectively, rotating output device 13 up to insert quarter turn fastener 66 into T slot 86, and then turning quarter turn fastener 66 a quarter turn to secure output device 13 to finishing device 12. Output device cover 88 is then installed and connector 90 (shown in FIG. 6) plugged in to finishing device 12 to provide power to output device 13 and to establish signal communication between the operative components of output device 13 and finishing device 12.

A cover sensor 92 may be used as a safety feature to disable output device 13 when cover 88 is removed from device 13. A magnetic proximity sensor (a Reed Switch, for example), an optical sensor or any other suitable sensor 92 electrically coupled to controller 94 may be used to detect whether cover 88 is installed on output device 12. If a magnetic proximity sensor is used, a magnet 93 is placed in cover 88 near sensor 92. If sensor 92 signals controller 94 that cover 88 is removed, then controller 94 will not energize the operative components of output device 13.

Figure 7:
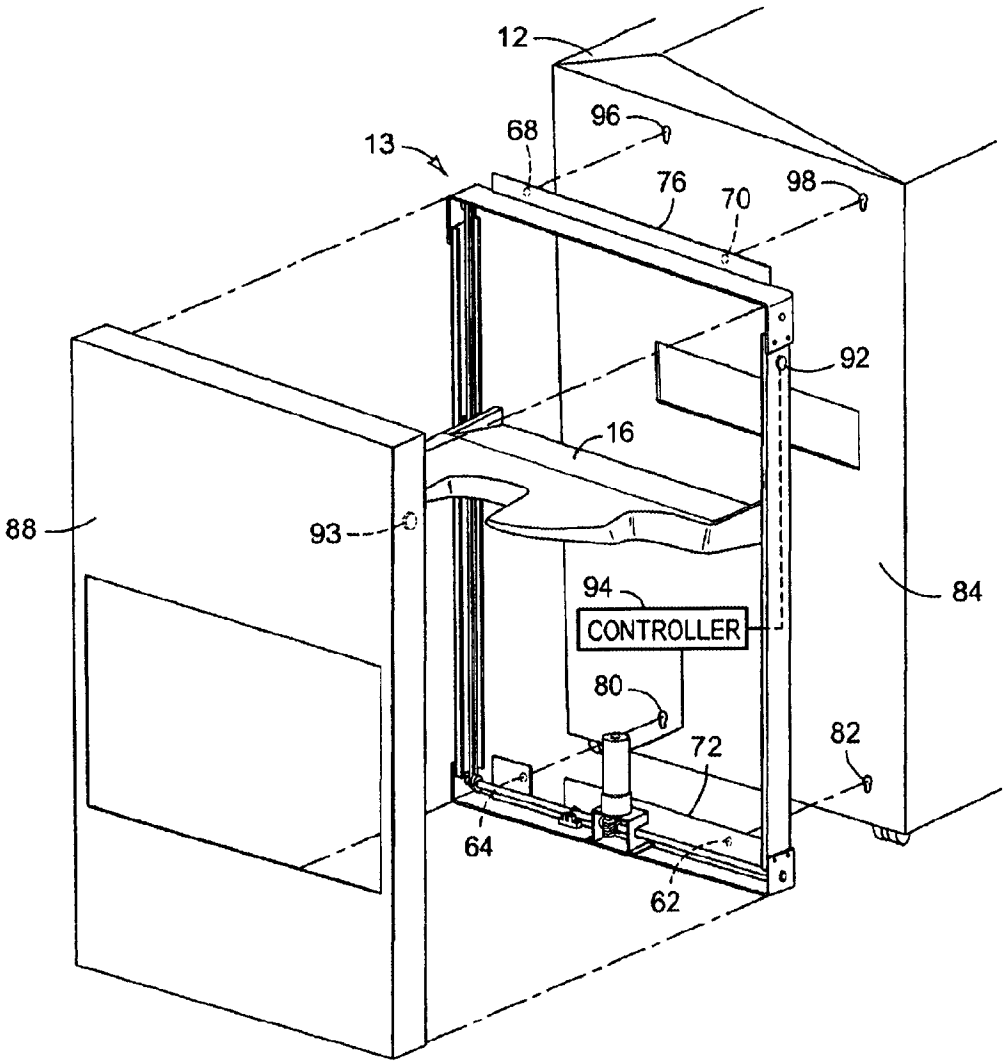
FIGS. 7 and 8 are exploded perspective views of an output device that incorporates quick release mounting fasteners according to a second embodiment of the invention mounting to a printer or post print finishing device.
Figure 8:
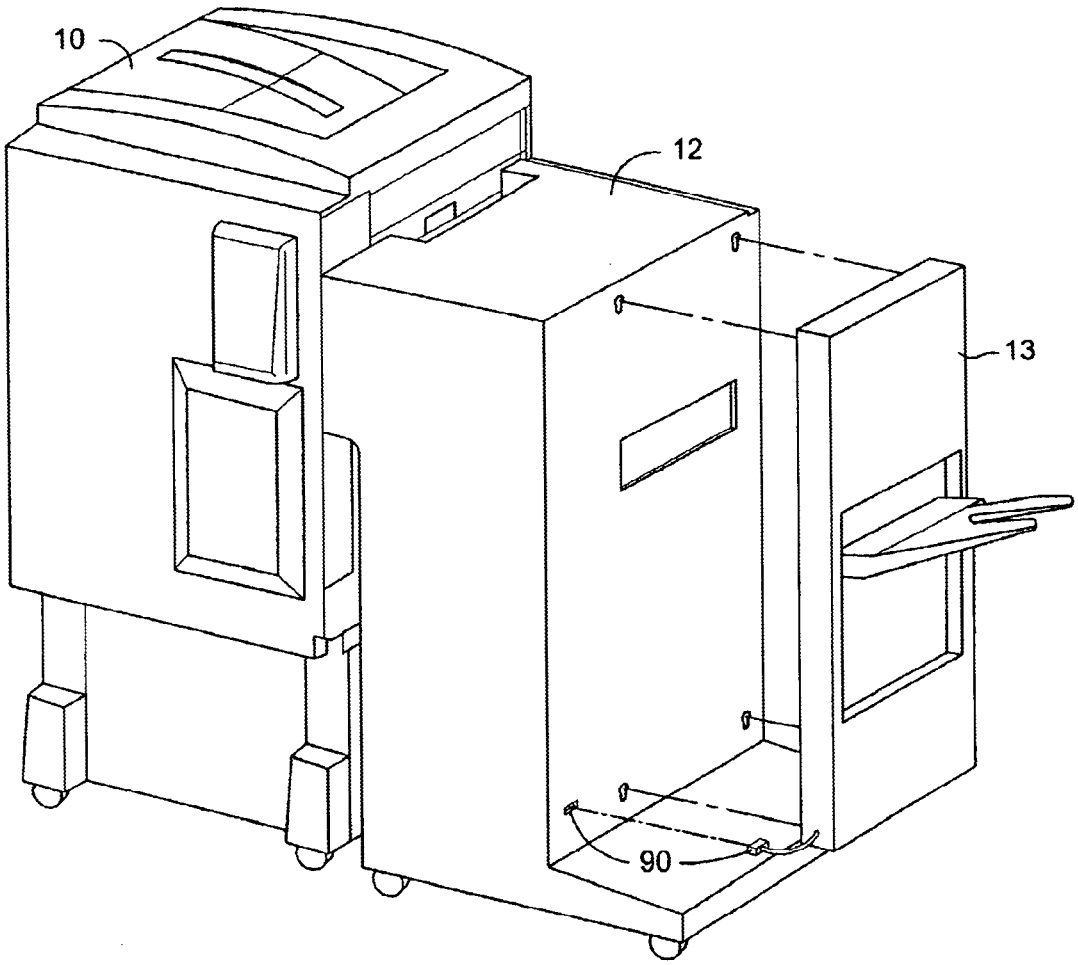

In the embodiment shown in FIGS. 7 and 8, two key hole plugs 68 and 70 are used instead of a quarter turn fastener. Key hole plugs 68 and 70 protrude from inside/upstream mounting surface 78 of upper flange 76 (surface 78 is shown in FIG. 4). Key holes 96 and 98 in housing panel 84 of finishing device 12 are aligned with key hole plugs 68 and 70, respectively, on output device 13. In this embodiment, output device 13 is mounted to finishing device rear panel 84 by inserting key hole plugs 62, 64 and 68, 70 into key holes 80, 82 and 96, 98.

A programmable controller 94 electrically coupled to reversing motor 46 and cover sensor 92 controls the position of tray 16 through the operation of motor 46. Although it is expected that controller 94 will be implemented as part of the controller for finishing device 12 shown in FIGS. 1 and 2, controller 94 could also be implemented as a discrete output device controller or as part of the printer controller for systems in which the printer controller controls print and post print operations or in systems in which the printer outputs directly to tray 16. As with conventional printer and finishing device controllers, controller 94 will typically include a processor and associated memory. Random access memory (RAM) or other suitable operational memory contains job data from the attached printer or host computer along with programming and other data currently being executed or used by the processor. Read only memory (ROM) or other suitable operational/storage memory contains the device firmware that provides programming instructions to control the operation of finishing device 12 and output device 13. Controller 94 executes firmware-programming instructions according to command inputs from the attached printer or host computer and in response to input from sensors and other components of finishing device 12 and output device 13.

The exemplary embodiments shown in the figures and described above illustrate but do not limit the invention. Other forms, details, and embodiments may be made and implemented. Hence, the foregoing description should not be construed to limit the spirit and scope of the invention, which is defined in the following claims.

What is claimed is:

1. A print media output device, comprising:

a rectangular frame having a top, a bottom opposite the top and vertically oriented parallel sides each extending between the top and the bottom;

a horizontally oriented output receptacle extending between the sides;

a quick release fastener connected to the frame top; and a quick release fastener connected to the frame bottom.

2. The device of claim 1, further comprising a flange affixed to the frame top and a flange affixed to the frame bottom and wherein the quick release fasteners comprise a quick release fastener attached to each flange.

3. The device of claim 1, wherein the quick release fasteners comprise:

a quarter turn fastener disposed at or near a center of one of the frame top or the frame bottom; and a pair of key hole plugs disposed opposite one another on the other of the frame top or the frame bottom.

4. The device of claim 1, wherein the quick release fasteners comprise:

a first pair of key hole plugs disposed opposite one another along the frame top; and a second pair of key hole plugs disposed opposite one another along the frame bottom.

5. A print media output device, comprising:

a rectangular frame having a top, a bottom opposite the top and vertically oriented parallel sides each extending between the top and the bottom;

a horizontally oriented output receptacle extending between the sides;

a top flange affixed to and extending along the frame top;

a bottom flange affixed to and extending along the frame bottom;

a quarter turn fastener positioned at or near a center of one of the top flange or the bottom flange; and a pair of key hole plugs disposed opposite one another on the other of the top flange or the bottom flange.

6. The device of claim 5, wherein the top flange is integral to and defines an upstream mounting surface of the frame top and the bottom flange is integral to and defines an upstream mounting surface of the frame bottom.

7. The device of claim 5, wherein the top flange is coextensive with and defines the frame top and the bottom flange is coextensive with and defines the frame bottom.

8. A print media output device, comprising:

a rectangular frame having a top, a bottom opposite the top and vertically oriented parallel sides each extending between the top and the bottom;

a horizontally oriented output receptacle extending between the sides;

a top flange affixed to and extending along the frame top;

a bottom flange affixed to and extending along the frame bottom;

a first pair of key hole plugs disposed opposite one another on the top flange; and a pair of key hole plugs disposed opposite one another on the bottom flange.

9. A system for mounting a print media output device that includes a frame supporting an output receptacle to a printer or post print finishing device that includes a housing, the system comprising:

a quarter turn fastener on a top part of the output device frame;

a pair of key hole plugs on a bottom part of the output device frame;

a T slot in the finishing device housing aligned with the quarter turn fastener on the output device frame; and a pair of key holes in the device housing aligned with the key hole plugs on the output device frame.

10. A system for mounting a print media output device that includes a frame supporting an output receptacle to a printer or post print finishing device that includes a housing, the system comprising:

a first pair of key hole plugs on a top part of the output device frame;

a second pair of key hole plugs on a bottom part of the output device frame;

a first pair of key holes in the finishing device housing aligned with the first pair of key hole plugs on the output device frame; and a second pair of key holes in the device housing aligned with the key hole plugs on the output device frame.

11. A frame for supporting a print media output receptacle, comprising:

a top having a first end and a second end;

a bottom having a first end and a second end;

a first rail defining a first side of the frame connecting the top first end and the bottom first end;

a second rail defining a second side of the frame connecting the top second end and the bottom second end;

the rails configured to guide movement of the media output receptacle; and a quick release fastener connected to the frame top; and a quick release fastener connected to the frame bottom.

12. A frame for supporting a print media output receptacle, comprising:

a top, a bottom opposite the top and parallel side rails extending between the top and the bottom, the rails configured to guide movement of the media output receptacle; and quick release fasteners connected to the frame top and frame bottom.

13. A print media output device, comprising:

a frame having parallel sides;

a rail integral to each side;

an output receptacle extending between and mounted to the rails for movement thereon; and a quick release fastener connected to the frame.

14. The device of claim 13, further comprising a reversing motor supported by the frame and operatively coupled to the output receptacle, the receptacle movable up and down along the rails at the urging of the motor.

15. The device of claim 14, further comprising:

a detachable cover covering the frame, rail and motor; and a sensor mounted to the frame, the sensor operative to sense whether or not the cover is installed covering the frame.

16. A print media output device, comprising:

a frame;

a pair of vertically oriented rails disposed parallel to and opposite one another, each rail defining one side of the frame;

a reversing motor supported by the frame; and a horizontally oriented output receptacle having a first side mounted to one rail and a second side mounted to the other rail;

a first drive train operatively coupled between the motor and the first side of the output receptacle;

a second drive train operatively coupled between the motor and the second side of the output receptacle;

the first drive train operationally identical to the second drive train such that both sides of the output receptacle move together at the urging of the motor; and a quick release fastener connected to the frame.

* * * * *